US009239055B2

(12) United States Patent
Park et al.

(10) Patent No.: US 9,239,055 B2
(45) Date of Patent: Jan. 19, 2016

(54) CROSS FLOW FAN AND AIR CONDITIONER HAVING THE SAME

(71) Applicant: LG ELECTRONICS INC., Seoul (KR)

(72) Inventors: Jeongtaek Park, Seoul (KR); Deok Huh, Seoul (KR); Jaehyuk Jung, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 424 days.

(21) Appl. No.: 13/683,130

(22) Filed: Nov. 21, 2012

(65) Prior Publication Data

US 2013/0126134 A1 May 23, 2013

(30) Foreign Application Priority Data

Nov. 22, 2011 (KR) ..... 10-2011-0122220

(51) Int. Cl.

| | |
|---|---|
| ***F04D 5/00*** | (2006.01) |
| ***F28F 13/12*** | (2006.01) |
| ***F04D 29/28*** | (2006.01) |
| ***F04D 29/38*** | (2006.01) |
| ***F04D 29/66*** | (2006.01) |
| ***F04D 17/04*** | (2006.01) |

(52) U.S. Cl.

CPC *F04D 5/00* (2013.01); *F04D 17/04* (2013.01); *F04D 29/283* (2013.01); *F04D 29/384* (2013.01); *F04D 29/666* (2013.01); *F28F 13/12* (2013.01)

(58) Field of Classification Search

CPC ..... F04D 17/04; F04D 29/30; F04D 29/282

See application file for complete search history.

(56) References Cited

U.S. PATENT DOCUMENTS

| | | | | |
|---|---|---|---|---|
| 7,815,419 | B2 * | 10/2010 | Teraoka et al. | 416/178 |
| 2009/0028719 | A1 * | 1/2009 | Teraoka et al. | 416/223 R |

FOREIGN PATENT DOCUMENTS

| | | | |
|---|---|---|---|
| CN | 1323952 | A | 11/2001 |
| CN | 1914424 | A | 2/2007 |
| CN | 101405506 | A | 4/2009 |
| EP | 0000597 | A1 | 2/1979 |
| EP | 1 367 322 | A1 | 12/2003 |
| JP | 11-141494 | A | 5/1999 |
| JP | 2005-120877 | A | 5/2005 |
| JP | 2008-002378 | A | 1/2008 |

OTHER PUBLICATIONS

Chinese Office Action issued in Application No. 201210477828.7 dated Jan. 14, 2015 (with English Translation).

* cited by examiner

*Primary Examiner* — Igor Kershteyn
(74) *Attorney, Agent, or Firm* — Ked & Associates LLP

(57) ABSTRACT

A cross flow fan and an air conditioner having the same are provided. The cross flow fan may include a fixing member having a plate shape, and a plurality of blades fixed to one surface of the fixing member. The plurality of blades may be arranged spaced apart from each other in a circumferential direction. An inner edge may define an end of a side of each of the plurality of blades, the inner edge extending toward a rotational shaft of the plurality of blades, and an outer edge may define an end opposite to the inner edge. A protrusion may protrude from the outer edge in one direction.

22 Claims, 10 Drawing Sheets

CROSS FLOW FAN AND AIR CONDITIONER HAVING THE SAME

CROSS-REFERENCE TO RELATED APPLICATION(S)

The present application claims priority to Korean Patent Application No. 10-2011-0122220, filed in Korea on Nov. 22, 2011, which is hereby incorporated by reference in its entirety.

BACKGROUND

1. Field

A cross flow fan and an air conditioner having the same are disclosed.

2. Background

Cross flow fans and air conditioners are known. However, they suffer from various disadvantages.

BRIEF DESCRIPTION OF THE DRAWINGS

Embodiments will be described in detail with reference to the following drawings in which like reference numerals refer to like elements, and wherein.

DETAILED DESCRIPTION

Figure 1:
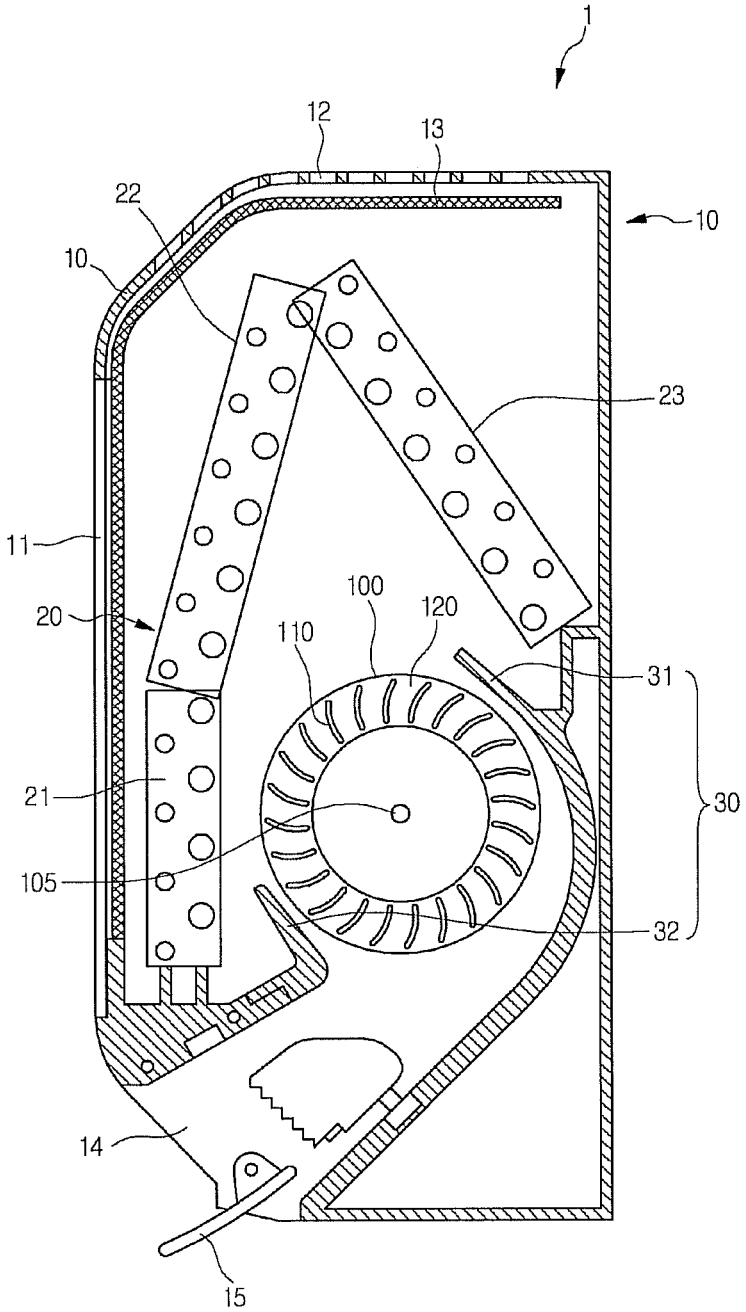
FIG. 1 is a cross-sectional view of an air conditioner according to an embodiment.

Hereinafter, a cross flow fan and an air conditioner have the same according to embodiments will be described in detail with reference to the accompanying drawings. Where possible, like reference numerals have been used to indicate like elements.

In general, air conditioners are apparatuses for cooling or heating an indoor space. Such an air conditioner may include a compressor that compresses a refrigerant; a condenser, in which the refrigerant discharged from the compressor may be condensed; an expander, in which the refrigerant having passed through the condenser may be expanded, and an evaporator, in which the refrigerant expanded in the expander may be evaporated.

The condenser and the evaporator of the air conditioner may serve as a heat exchanger that heat-exchanges the refrigerant with external air, and may be provided in an indoor device or an outdoor device. A cross flow fan that generates an air flow may be disposed on or at a side of the heat exchanger provided in the indoor device.

The cross flow fan may include a plurality of blades provided on a circular plate. The cross flow fan may radially discharge air suctioned in a radius direction. Moreover, the cross flow fan may suction indoor air into the indoor device to heat-exchange the indoor air with refrigerant flowing into the heat exchanger, and may then discharge the heat-exchanged air to the outside of the indoor device.

However, related art cross flow fan may generate a vortex in a flow of air discharged by the plurality of blades when the cross flow fan is rotated. Thus, noise and vibration may be transferred into an indoor room. As a result, a user may feel inconvenienced. Also, suction and discharge efficiency of air may be reduced due to the vortex, deteriorating the whole performance of the air conditioner.

FIG. 1 is a cross-sectional view of an air conditioner according to an embodiment. Referring to FIG. 1, an air conditioner 1 according to this embodiment may include a case 10, a heat exchanger 20, a fan 100, and a passage guide 30. The air conditioner 1 may be, for example, an indoor device.

The case 10 may include a front suction portion 11 disposed at a front side thereof and an upper suction portion 12 disposed at an upper side thereof. A filter 13 that filters air suctioned through the upper suction portion 12 may be disposed in each of the front suction portion 11 and the upper suction portion 12. The filter 13 may be disposed at front and upper portions of the case 10 to cover the front suction portion 11 and the upper suction portion 12, respectively. The filter 13 may be fixed to the front portion of the case 10 or detachably disposed on the front portion of the case 10.

The case 10 may have an air discharge portion 14 in a lower portion thereof. A discharge louver 15 that adjusts a discharge direction of air may be disposed in the air discharge portion 14. When operation of the air conditioner 1 is stopped, the discharge louver 15 may be closed to cover the air discharge portion 14.

The heat exchanger 20 may be disposed within the case 10 to heat-exchange refrigerant with external air. The heat exchanger 20 may be a fin tube-type heat exchanger, including a refrigerant tube and a plurality of heat-exchange fins that passes through the refrigerant tube.

The heat exchanger 20 may be disposed to surround a suction side of the fan 100. For example, the heat exchanger 20 may include a plurality of heat exchange portions 21, 22, and 23. The heat exchange portions 21, 22, and 23 may be bent, and may be disposed to surround a periphery of the suction side of the fan 100. Thus, with respect to this embodiment, the heat exchanger 20 may have a relatively large size and be installed in the same space compared to prior heat exchangers, to increase heat-exchange capacity. Alternatively, the heat exchanger 20 may have an integrated bent shape.

Air introduced through the front and upper suction portions 11 and 12 may pass through the heat exchanger 20. More particularly, air introduced into the case 10 may be heat-exchanged with refrigerant flowing along the refrigerant tube, and thus, may be cooled or heated while passing through the heat exchange portions 21, 22, and 23. Thereafter, the cooled or heated air may be discharged into an indoor room through the air discharge portion 14, such that the indoor room has an environment desired by a user.

The fan 100 may be disposed on or at a side of the heat exchanger 20. The fan 100 may be a cross flow fan that radially discharges air suctioned in a radius direction.

A plurality of fan devices (not shown) may be coupled to each other in a lengthwise direction to configure or manufacture the cross flow fan 100. Each of the fan devices may include a fixing member 120, which may have a circular plate shape, a rotational shaft 105, and a plurality of blades 110 fixed to a top surface of the fixing member 120 and arranged spaced apart from each other in a circumferential direction. That is, the cross flow fan 100 may include the plurality of blades 110 arranged along the circumferential direction. The blades 110 of the cross flow fan 100 will be described in detail hereinafter.

The passage guide 30 may be disposed around an outer circumferential surface of the cross flow fan 100 to guide a flow of air. That is, the passage guide 30 may smoothly guide the suction and discharge of air within the cross flow fan 100. The passage guide 30 may include a rear guide 31 and a stabilizer 32.

The rear guide 31 may extend from a rear side of the case 10 toward the suction side of the cross flow fan 100, as shown in FIG. 1. The rear guide 31 may smoothly guide the suctioned air toward the cross flow fan 100 when the cross flow fan 100 is rotated. Also, the rear guide 31 may minimize a phenomenon in which air flowing by the cross flow fan 100 is delaminated within the cross flow fan 100.

The stabilizer 32 may be disposed on a discharge side of the cross flow fan 100. The stabilizer 32 may be installed spaced from an outer surface of the cross flow fan 100 to prevent the air discharged from the cross flow fan 100 from backwardly flowing toward the heat exchanger 20.

The rear guide 31 and the stabilizer 32 may be disposed along a lengthwise direction of the cross flow fan 100. Further, the rear guide 31 and the stabilizer 32 may be spaced a predetermined distance from the outer surface of the cross flow fan 100.

When the cross flow fan is rotated, air may be suctioned through the front and upper suction portions 11 and 12. Thereafter, the suctioned air may be heat-exchanged with refrigerant while passing through the heat exchanger 20 and may then flow toward the cross flow fan 100. The air may be smoothly guided by the rear guide 31.

Thereafter, the cross flow fan 100 may allow air to flow from the rear guide 31 toward the air discharge portion 14. As the introduction of the air discharged from the cross flow fan 100 toward the heat exchanger 20 may be restricted by the stabilizer 32, the air within the air discharge portion 14 may be smoothly discharged into the indoor space.

Figure 2:
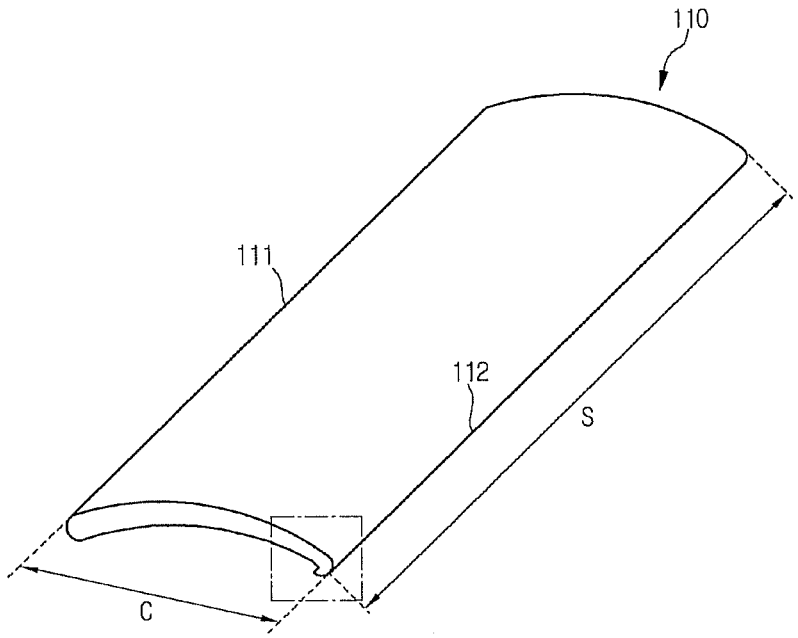
FIG. 2 is a perspective view of a blade of a cross-flow fan of the air conditioner of FIG. 1.
Figure 3:
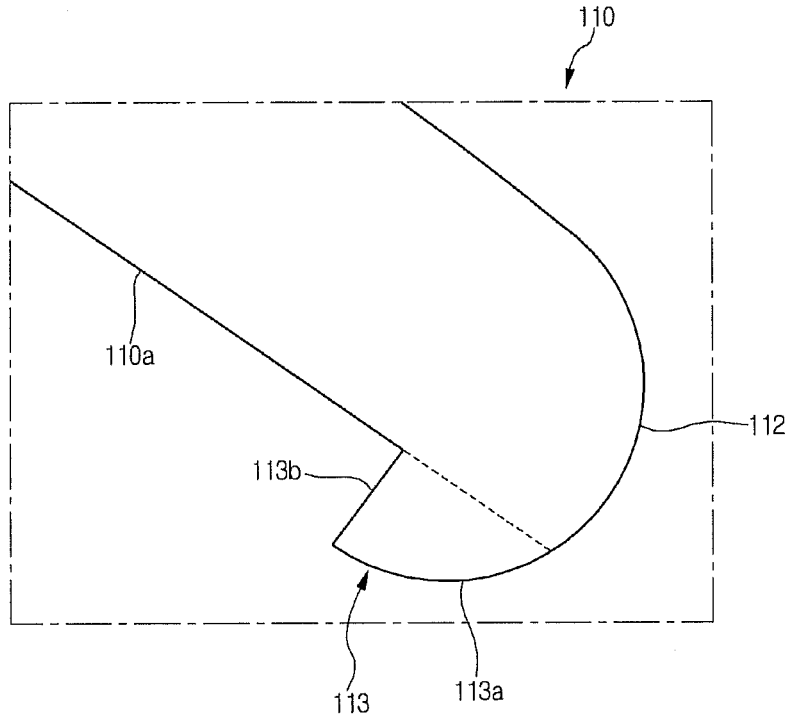
FIG. 3 is a partially enlarged view of the blade of FIG. 2.

FIG. 2 is a perspective view of a blade of a cross-flow fan of the air conditioner of FIG. 1. FIG. 3 is a partially enlarged view of the blade of FIG. 2.

Referring to FIGS. 2 and 3, with the blades 110 of the cross flow fan 100 according to this embodiment, a line extending along a lengthwise direction of the blade 110 may be defined as a span S, and a line extending perpendicular to the span S may be defined as a chord C, referring to FIG. 2. Also, an inner front end defined along the lengthwise direction (the span S) of the blades 110 may be defined as an inner edge 111, and an outer front end defined along the lengthwise direction (the span S) of the blades 110 may be defined as an outer edge.

When each of the blades 110 is installed on the cross flow fan 110, the inner edge 111 may face an inside of the cross flow fan 100, and the outer edge 112 may face an outside of the cross flow fan 100. Each of the inner edge 111 and the outer edge 112 may have a rounded cross-section. The inner edge 111 of the blade 110 may be disposed to extend substantially parallel to the rotational shaft 105 of the cross flow fan 100.

The inner edge 111 and the outer edge 112 may have a thickness different from each other. In more detail, the blade 110 may have a thickness that gradually decreases from the inner edge 111 toward the outer edge 112.

A protrusion 113 that reduces an occurrence of a vortex from the discharged air may be disposed on an end of each of the blades 110. The protrusion 113 may protrude from a bottom surface of an end of the blade, as shown in FIG. 3.

In more detail, the protrusion 113 may extend from the outer edge 112 of the blade 110 in one direction. The direction in which the protrusion 113 extends from the outer edge 112 may be substantially perpendicular to a direction extending from the inner edge 111 toward the outer edge 112. In other words, the direction in which the protrusion 113 extends may cross a tangential direction of the outer edge 112.

A sum of the thickness of the outer edge 112 and a protruding thickness of the protrusion 113 may be equal to the thickness of the inner edge 111. This allows smooth suctioning or discharging of air.

When air passing through a center of the cross flow fan 100 flows along the bottom surface of the blade 110, a vortex may occur in the flow of air between the passage guide 30 and the blade 110. In this case, the protrusion 113 disposed on the blade 110 scatters the vortex a small amount restricting irregular flow of air due to the vortex. Thus, the blade 110 may smoothly discharge the air introduced through the front and upper suction portions 11 and 12 along the air discharge portion 14 to increase a discharge amount of air.

The protrusion 113 may have an outer surface 113*a* extending roundly from the outer edge 112 toward the bottom surface of the blade 110. The outer surface 113*a* may be smoothly connected to the outer edge 112 of the blade 110 to form the same surface as the outer circumferential surface of the outer edge 112.

In other words, the outer surface 113*a* of the protrusion 113 may be connected to the outer circumferential surface of the outer edge 112. Thus, the outer surface 113*a* may have a curved shape on the whole from the outer edge 112 to the protrusion 113. This may prevent a suction flow amount of air from being reduced by the protrusion 113 when the air is suctioned through or by the outer surface 113*a* of the protrusion 113.

The protrusion 113 may have an inner surface 113*b* that extends from an end of the outer surface 113*a* toward the blade 110. The inner surface 113*b* may be coupled to a bottom surface 110*a* of the blade 110. The bottom surface 110*a* may be a surface facing the inside of the cross flow fan 100 of two surfaces connecting the inner edge 111 to the outer edge 112, that is, a surface facing the rotational shaft 105 of the cross flow fan 100.

The inner surface 113*b* may have a planar shape inclined at a certain angle with respect to the bottom surface 110*a* of the blade 110. An angle between the inner surface 113*b* of the protrusion 113 and the bottom surface 110*a* may be an acute angle (0°~90°).

In a case in which the inner surface 113*b* of the protrusion 113 has the above-described shape, when air is introduced along the outer edge 112 of the blade 110, a vortex may occur in a space between the bottom surface of the blade 110 and the protrusion 113. On the other hand, when the air is discharged, the protrusion 113 may reduce the occurrence of the vortex. That is, the protrusion 113 may reduce the occurrence of the vortex in the discharged air, as well as, generate the vortex in the introduced air.

However, as an inflow rate of air through the blade 110 may be less than a discharge rate of the air, even though the protrusion 113 may generate the vortex in a suction region, a degree of the reduction of the vortex may be greater in the discharge region. As a result, the whole efficiency of the fan may be sufficiently increased.

Figure 4:
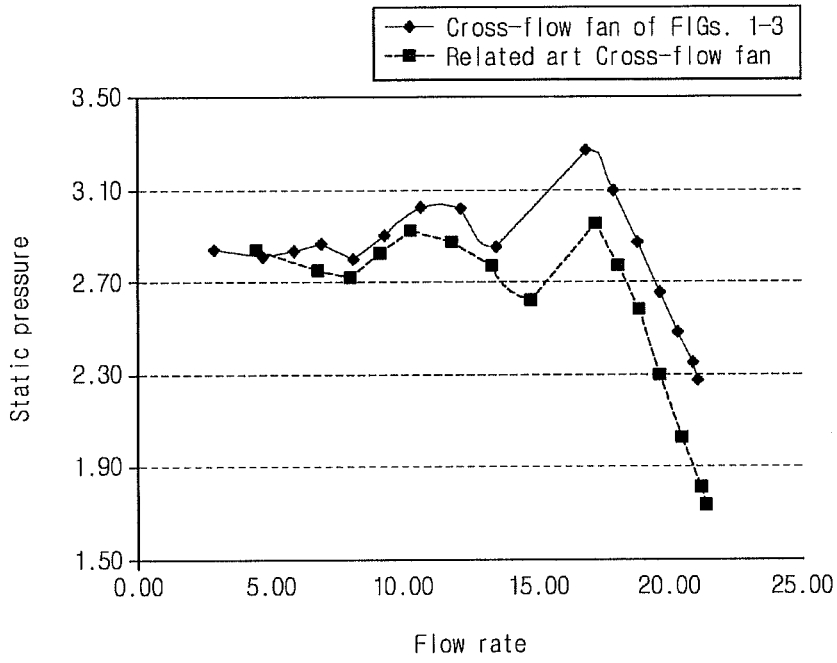
FIG. 4 is a graph illustrating results obtained by comparing performances of a related art cross flow fan art to the cross-flow fan according to the embodiment of FIGS. 1-3.

FIG. 4 is a graph illustrating results obtained by comparing performances of a related art cross flow fan to the cross flow fan according to this embodiment. In FIG. 4, the vertical coordinate represents flow amount, and the horizontal coordinate represents static pressure. In FIG. 4, the related art cross flow fan (dotted-line), a cross flow fan using a general blade in which a protrusion is not provided, is compared to a cross flow fan according to the embodiment of FIGS. 1-3 (solid line) under the same driving RPM.

Referring to FIG. 4, the cross flow fan 100 according to this embodiment may have a higher static pressure under the same flow amount and a higher flow amount under the same static pressure when compared to those of the related art. That is, with this embodiment, when compared to the related art, the vortex may be controlled in the discharge region using the protrusion 113 to increase the total flow amount and improve static pressure performance.

Figure 5:
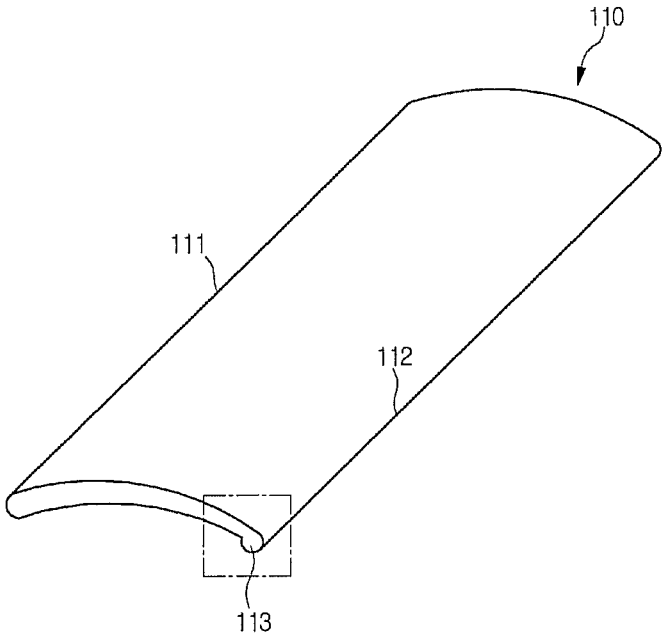
FIG. 5 is a perspective view of a blade of a cross-flow fan according to another embodiment.
Figure 6:
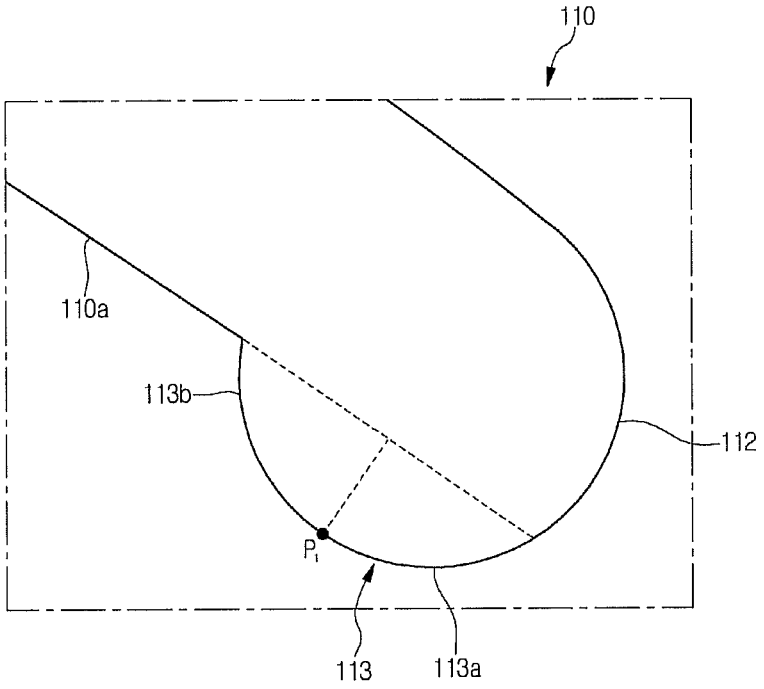
FIG. 6 is a partially enlarged view of the blade of FIG. 5.

FIG. 5 is a perspective view of a blade of a cross-flow fan according to another embodiment. FIG. 6 is a partially enlarged view of the blade of FIG. 5.

Referring to FIGS. 5 and 6, a blade 110 according to this embodiment may include a protrusion 113 that protrudes from an outer edge 112 of the blade 110 toward the inside of a cross flow fan. However, unlike the previous embodiment, the protrusion 113 according to this embodiment may have a curved surface convex toward a bottom surface of the blade 110. This structure may reduce an occurrence of a vortex in a suction region.

Alternatively, an outer surface 113*a* of the protrusion 113 may be connected to an outer edge 112 of the blade 110 in a curved shape, like the previous embodiment. With this embodiment, when the outer surface 113*a* and the inner surface 113*b* of the protrusion 113 have the curved shape convex from a bottom surface 110*a* of the blade 110, an effect in which the vortex is scattered in the discharge region may be reduced, and an amount of a vortex generated in the suction region may also be reduced.

When a point that bisectionally divides a length of an outer circumferential surface of the protrusion 113 is point P (see FIG. 6), a section from the outer edge 112 up to the point P may be referred to as the outer surface 113*a*, and a section from the section P up to the bottom surface 110*a* may be referred to as the inner surface 113*b*.

Figure 7:
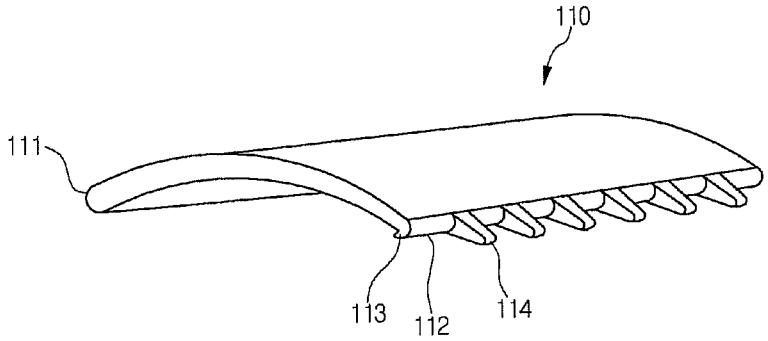
FIG. 7 is a perspective view of a blade of a cross-flow fan according to another embodiment.
Figure 8:
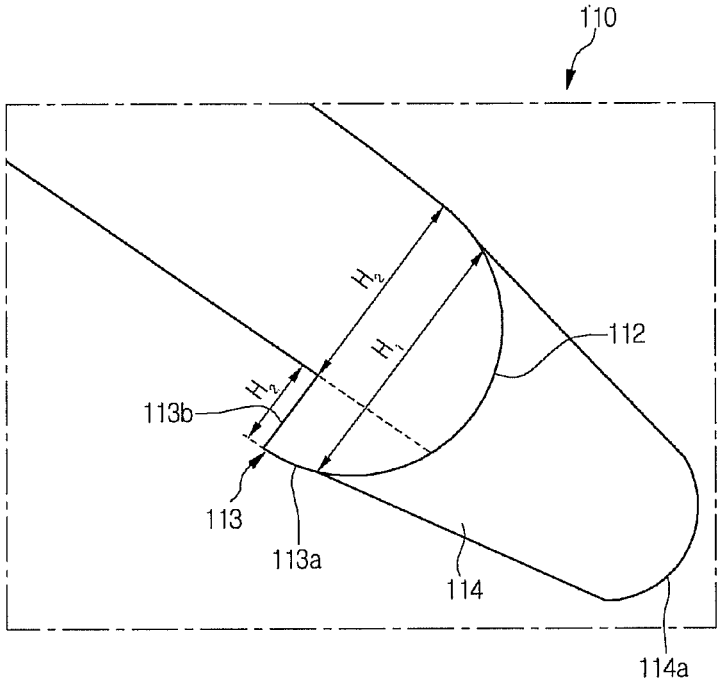
FIG. 8 is a side view of the blade of FIG. 7.

FIG. 7 is a perspective view of a blade of a cross-flow fan according to another embodiment. FIG. 8 is a side view of the blade of FIG. 7.

Referring to FIGS. 7 and 8, a protrusion 113, which may protrude toward the inside of the cross flow fan, and a plurality of projections 114, which may protrude toward the outside of the cross flow fan or the blade 110 may be disposed on an outer edge of the blade 110 according to this embodiment. The protrusion 113 may have the same shape as that of the protrusion according to the embodiment of FIGS. 1-3. However, the shape of the protrusion 113 according to this embodiment is not limited to that of the protrusion according to the embodiment of FIGS. 1-3.

The projection 114 may reduce the intensity of a vortex in a flow of air discharged from the cross flow fan 100 to increase a flow amount and reduce noise. The plurality of projections 114 may be disposed spaced a predetermined distance from each other in a lengthwise direction of the blade 110.

A direction in which the protrusion 113 extends from the outer edge 112 may cross a direction the projection 114 extends from the outer edge 112. Further, the projection 114 may have a curved end 114*a*. This may prevent air from being resisted by the projection 114 when the air is introduced into the blade 110.

The projection 114 may have a square shape when viewed from a top or bottom surface of the blade 110. Here, the "bottom surface" may correspond to the bottom surface 110*a* described with respect to the embodiment of FIGS. 1-3, and the "top surface" may be a surface opposite to the "bottom surface".

More specifically, the projection 114 may have a shape (for example, a trapezoid shape) having a width that gradually decreases toward the end thereof. This is the same as if the outer surface of the projection 114 has a curved shape. That is, this may prevent a flow of air introduced into the cross flow fan 110 from being interrupted. Also, the projection 114 may have a thickness that gradually decreases toward the end thereof.

An end of the projection 114 attached to the blade 110 may have a thickness H1 greater than or equal to a thickness H2 of the outer edge 112 and less than or equal to a sum of the thickness of the outer edge 112 and a protruding thickness H3 of the protrusion 113.

As the protrusion 113 is disposed on the bottom surface of the blade 110 in this embodiment, the outer edge of the blade 110 may be thicker than a thickness of the blade 110 according to the related art. As the projection 114 may be coupled to the outer edge 112 and the protrusion 113, the projection 114 may be thicker by the thickness of the protrusion 113 than that of the outer edge 112.

That is, as a coupling area or region of the projection 114 and the blade 110 may be expanded by the protrusion 113, a coupling strength of the projection 114 may be improved.

Figure 9A:
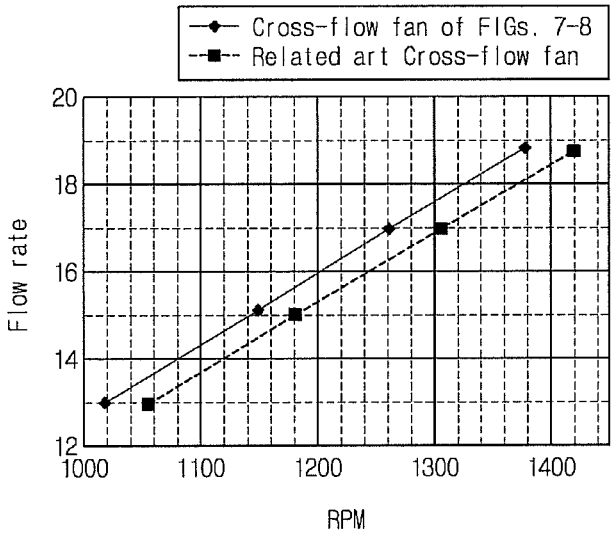
FIGS. 9A-9B are graphs illustrating results obtained by comparing performances of a related art cross flow fan to a cross flow fan according to the embodiment of FIGS. 7-8.
Figure 9B:
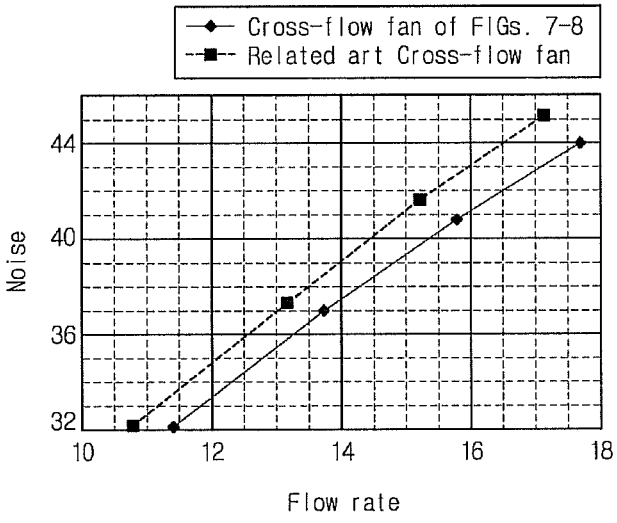

FIGS. 9A-9B are graphs illustrating results obtained by comparing performances of a related art cross flow fan and a cross flow fan according to the embodiment of FIGS. 7-8. In FIG. 9A, the vertical coordinate represents a RPM of a motor for driving the fan, and the horizontal coordinate represents flow amount. In FIG. 9B, the vertical coordinate represents flow amount, and the horizontal coordinate represents noise. In FIG. 9B, the related art and the embodiment of FIG. 7 are performed under the same driving RPM. Also, in FIGS. 9A-9B, the related art cross flow fan (dotted-line), a cross flow fan using a general blade in which the protrusion or projection is not provided, is compared to a cross flow fan according to the embodiment of FIGS. 7-8 (solid line).

Referring to FIGS. 9A-9B, the cross flow fan 100 according to the embodiment of FIG. 7 may secure a high flow amount under the same driving RPM when compared to that of the related art cross flow fan. This represents that a sufficient flow amount may be secured even though the cross flow fan 100 is driven at a relatively low RPM than that of the related art cross flow fan. Thus, according to this embodiment, power consumption may be reduced by about 5%.

Also, with this embodiment, in a case in which the same flow amount is secured, noise may be reduced when compared to the related art cross flow fan. Thus, according to this embodiment, when a certain flow amount is suctioned and discharged, the noise occurring due to the air flow may be reduced to improve a user's satisfaction.

Figure 10:
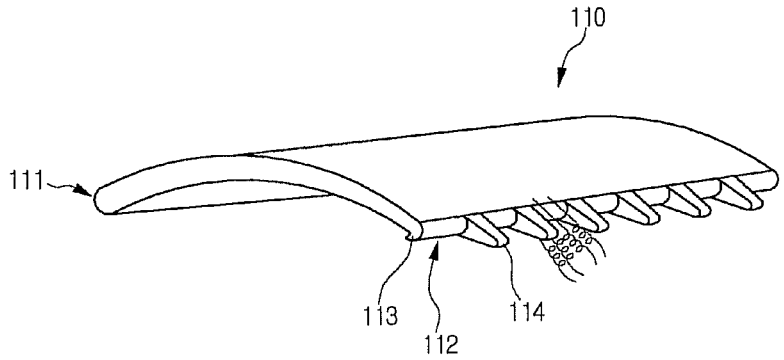
FIG. 10 is a view illustrating a flow of air in the blade of FIG. 7.

FIG. 10 is a view illustrating a flow of air in the blade of FIG. 7. Referring to FIG. 10, in the blade according to this embodiment, when air is discharged, a vortex flowing along a top surface of the blade 110 and a vortex flowing along the projection 114 are generated in plurality in a span S direction. The vortex flowing along the top surface of the blade 110 and the vortex flowing along the projection 114 may be offset against each other because the vortexes are rotated in directions opposite to each other. Thus, according to this embodiment, an overall intensity of the vortex may be reduced by the projection 114 to increase the flow amount and reduce noise.

According to embodiments disclosed herein, the protrusion, which may protrude from the outer edge of the blade toward the bottom surface of the blade may reduce the occurrence of the vortex and increase the flow amount of air, thereby improving efficiency of the cross flow fan.

Also, according to embodiments disclosed herein, the protrusion which may protrude toward the outside of the cross flow fan may have the curved surface to prevent the suction flow amount from being reduced when air is suctioned by the blade.

Also, according to embodiments disclosed herein, a plurality of projections may be provided on the outer edge of the blade to reduce the intensity of vortex in the air discharge region. The projections may be coupled to the outer edge of the blade and the protrusion to secure the sufficient thickness of the projection, thereby improving durability of the projection.

Embodiments disclosed herein provide a cross flow fan in which a protrusion and projection may be provided on an outer edge of a blade to reduce noise and improve discharge efficiency, and an air conditioner having the same.

Embodiments disclosed herein provide a cross flow fan that may include a fixing member having a plate shape; a plurality of blades fixed to one surface of the fixing member, the plurality of blades being arranged spaced apart from each other in a circumferential direction. An inner edge may define an end of a side of each of the blades, the inner edge extending toward a rotational shaft of the blades, an outer edge may define an end opposite to the inner edge, and a protrusion may protrude from the outer edge in one direction.

Embodiments disclosed herein provide an air conditioner that may include a heat exchanger disposed within a case; a cross flow fan disposed on a side of the heat exchanger, the cross flow fan including a plurality of blades; and a passage guide disposed around an outer circumference surface of the cross flow fan. A protrusion may protrude toward a bottom surface of each of the blades and a plurality of projections may protrude toward the outside of each of the plurality of blades.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A cross flow fan, comprising:

a fixing member fixed to a rotational shaft;

a plurality of blades fixed to the fixing member, wherein the plurality of blades is arranged spaced apart from each other in a circumferential direction of the fixing member, and wherein each of the plurality of blades includes:

an inner edge that extends substantially parallel to and faces the rotational shaft and an outer edge that extends opposite to the inner edge;

a protrusion that protrudes from the outer edge; and a bottom surface that faces an inside of the cross flow fan of two surfaces that connect the inner edge to the outer edge, wherein the protrusion protrudes from the bottom surface, and wherein the protrusion includes an outer surface that extends roundly from the outer edge toward the bottom surface.

2. The cross flow fan according to claim 1, wherein the fixing member has a plate shape.

3. The cross flow fan according to claim 1, wherein the protrusion further includes an inner surface bent from the outer surface, the inner surface being coupled to the bottom surface.

4. The cross flow fan according to claim 1, wherein the outer surface and the outer circumferential surface of the outer edge are the same surface.

5. The cross flow fan according to claim 3, wherein the inner surface is planar and extends from the outer surface toward the bottom surface.

6. The cross flow fan according to claim 3, wherein the inner surface has a curved shape and extends from the outer surface toward the bottom surface.

7. The cross flow fan according to claim therein a direction in which the protrusion extends from the outer edge crosses a direction extending from the inner edge toward the outer edge.

8. The cross flow fan according to claim 1, wherein a direction in which the protrusion extends from the outer edge crosses a tangential direction of the outer edge.

9. The cross flow fan according to claim 1, wherein two surfaces include:

the bottom surface from which the protrusion protrudes; and a top surface opposite to the bottom surface.

10. The cross flow fan according to claim 9, wherein the bottom surface has a predetermined curvature such that the bottom surface faces an inside of the cross flow fan.

11. The cross flow fan according to claim 1, further including a plurality of projections that protrudes toward an outside of the respective blade, wherein each of the plurality of projections has an end having a curved shape.

12. The cross flow fan according to claim 11, wherein a direction in which the protrusion extends from the outer edge crosses a direction in which each of the plurality of projections extends from the outer edge.

13. The cross flow fan according to claim 11, wherein each of the plurality of projections has a width that gradually decreases toward an end thereof.

14. The cross flow fan according to claim 11, wherein each of the plurality of projections has a thickness that gradually decreases from an end of a first side thereof attached to the outer edge toward an end of a second side thereof.

15. The cross flow fan according to claim 11, wherein an end of each projection attached to the respective blade has a thickness greater than or equal to a thickness of the outer edge and less than or equal to a sum of a thickness of the outer edge and a protruding thickness of the protrusion.

16. The cross flow fan according to claim 1, wherein a sum of a thickness of the outer edge and a protruding thickness of the protrusion is equal to a thickness of the inner edge.

17. An air conditioner comprising the cross flow fan according to claim 1.

18. An air conditioner, comprising:

a case;

a heat exchanger disposed within the case;

a cross flow fan disposed on one side of the heat exchanger, wherein the cross flow fan includes a plurality of blades; and a passage guide disposed around an outer circumferential surface of the cross flow fan, wherein an outer edge of each of the plurality of blades is provided with a protrusion that protrudes toward or from one surface of the respective blade, and wherein each protrusion includes a curved outer surface that extends roundly from the outer edge toward the one surface of the respective blade.

19. The air conditioner according to claim 18, wherein the outer edge of each of the plurality of blades is provided with a plurality of projections that protrudes toward an outside of the respective blade, and wherein each projection has a width and thickness that gradually decreases toward an end thereof.

20. The air conditioner according to claim 19, wherein an end of the projection attached to the respective blade has a thickness greater than or equal to a thickness of the outer edge and less than or equal to a sum of a thickness of the outer edge and a protruding thickness of the protrusion.

21. The air conditioner according to claim 18, wherein each protrusion includes an inner surface that extends from an end of the outer surface, the inner surface being coupled to the one surface of the respective blade.

22. The air conditioner according to claim 21, wherein the inner surface has a planat or curved shape.

* * * * *